United States Patent [19]

Tolmie, Jr.

[11] 4,342,512

[45] Aug. 3, 1982

[54] COPY CYCLE CONTROLLER FOR AN ELECTROSTATIC COPIER

[75] Inventor: Robert J. Tolmie, Jr., Brookfield Center, Conn.

[73] Assignee: Pitney Bowes Inc., Stamford, Conn.

[21] Appl. No.: 207,175

[22] Filed: Nov. 17, 1980

[51] Int. Cl.[3] ..... G03G 15/00

[52] U.S. Cl. ..... 355/14 SH; 355/3 SH

[58] Field of Search ..... 355/14 SH, 3 SH, 13, 355/14 R

[56] References Cited

U.S. PATENT DOCUMENTS 3,330,179 7/1967 Zerfahs et al. ..... 355/14 SH 3,706,490 12/1972 Aasen et al. ..... 355/13

3,843,251 10/1974 Washio et al. ..... 355/13

4,170,414 10/1979 Hubert et al. ..... 355/14 SH

*Primary Examiner*—Richard L. Moses

*Attorney, Agent, or Firm*—Peter Vrahotes; William D. Soltow, Jr.; Albert W. Scribner

[57] ABSTRACT

A timing system for controlling the timing sequence of a copy machine capable of accommodating variable copy length and having multi-copy, in-transit capability. The copy cycle control system includes two separate timers. A switch is actuated by the leading edge of an original to be copied and enables the first timer. The second timer is enabled by the same switch when it is turned off as a result of the trailing edge of the original passing thereover. This allows multiple copies to be made without the machine ceasing operations prematurely regardless of the size of gap between originals.

5 Claims, 2 Drawing Figures

COPY CYCLE CONTROLLER FOR AN ELECTROSTATIC COPIER

BACKGROUND OF THE INVENTION

This invention has utility in those types of copiers that have automatic document feeders which feed original documents past the exposure station of the copier without the need of operator intervention or assistance. Usually a copier of this type will also have provisions to allow manual feeding of originals past the exposure station. In such machines, the copying process is normally started when a start switch is actuated to start the automatic document feeder. The copier functions commence when the leading edge of a document to be copied engages a path switch located adjacent the exposure station. Usually the trailing edge of the original will be used to discontinue operations when it passes the same path switch. As a second document is convened past the same switch, then the process is repeated again. Although in normal operations this sequence of operation works well because the gap or space between documents is sufficiently great to allow the copy cycle to be completed, it presents certain problems when the documents are manually fed too closely together. In such a situation, the copy cycle would start as soon as the leading edge of a document is sensed by the path switch, the copy cycle would start from the beginning and the latter part of the copying cycle, which involves turning off components, would be interrupted. This is of particular concern when a solonoid designed for intermittent duty is used to actuate a knife.

BRIEF DESCRIPTION OF THE INVENTION

The copy cycle control system of this invention includes two timers. The first timer starts counting when a path switch adjacent to the exposure station is actuated. This takes place after the motor and the automatic document feeder (ADF), on those occasions when the ADF is to be used, have been started as a result of the operator pushing a start switch. The first timer is reset to "0" by the lead edge of each original and will start to count. As the first timer counts up, it will turn on and off the various components of the copier at predetermined times from the time when the lead edge of the last original to be copied engages the path switch. The outputs of the timer are decoded and used to time all sequential machine functions such as turning on the exposure lamp, timing the high voltage power supply (H.V.P.S.) and other required functions that must take place to complete the copy cycle. A second timer is used to turn off functions, such as turning off the high voltage power supply and the lamp. The second timer is included so that the sequence of the required functions can take place even through the first timer is reset to zero when a second or subsequent original engages the path switch and before the first timer completes the copy cycle.

DETAILED DESCRIPTION OF THE INVENTION

Figure 1:
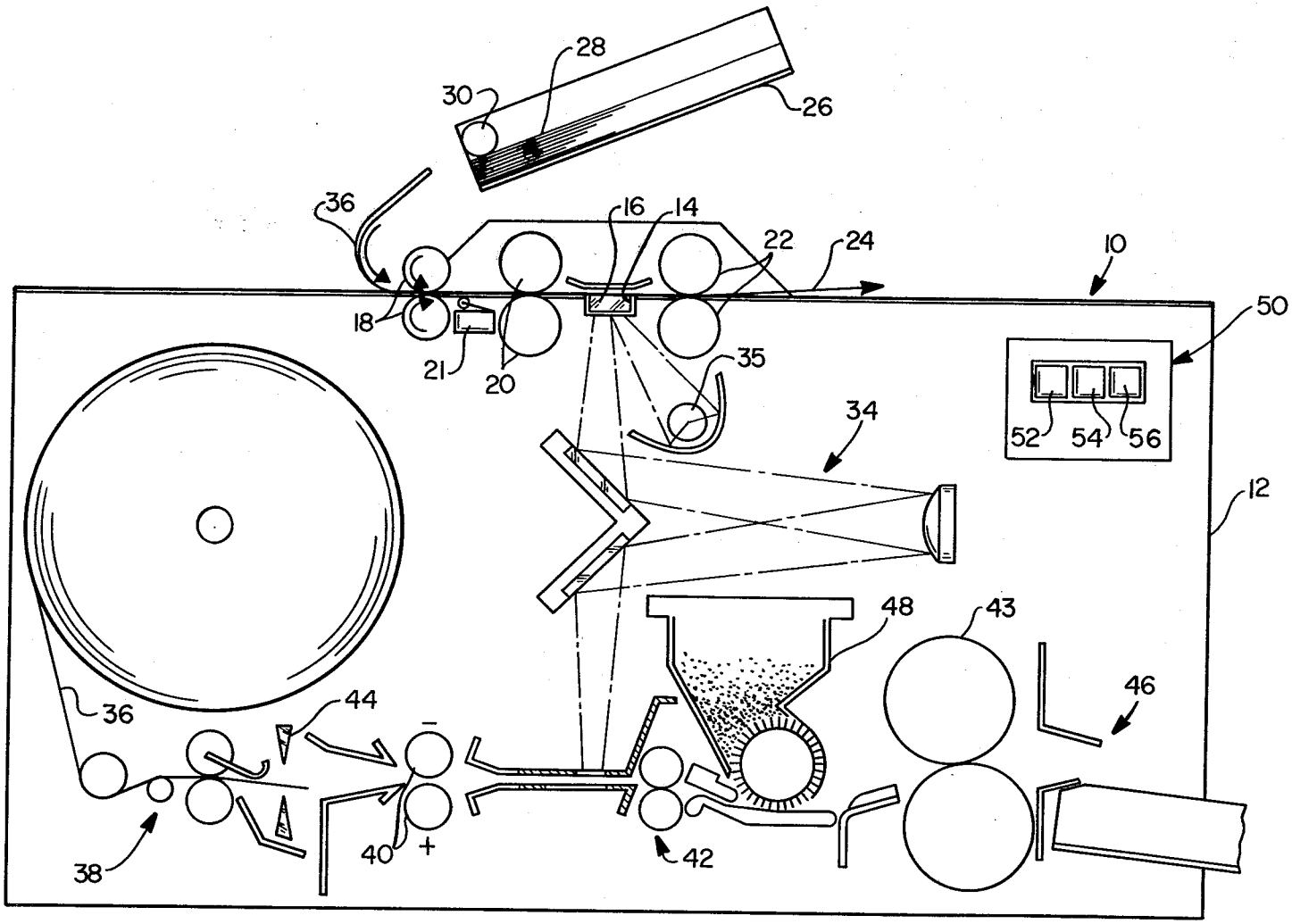
FIG. 1 shows a longitudinal cross sectional view of a copier in which the principles of the instant invention may be utilized.

Referring now to FIG. 1, a copier of the type that may utilize the instant invention is shown generally at 10 and has a housing 12 that supports the various cmponents of the copier. The housing 12 has an opening 14 with a glass plate 16 therein that define an exposure station across which an original that is to be copied is conveyed so as to be exposed to the optical system of the copier 10. A pair of drive rollers 18 are supported by the housing at the upper portion of the housing 12 to receive an original that is to be conveyed and a second pair of drive rollers 20 are located downstream from the first pair. A path switch 21 is located between the the two pairs of rollers 18, 20 to sense the leading and trailing edges of originals as they are conveyed thereacross. On the downstream side of the exposure station 16, is another pair rollers 22. The pairs of rollers 18, 20 and 22 define a path 24 over when an original is to be copied would be conveyed. Located above the housing 12 and supported thereby (by means not shown) is an automatic document feeder (ADF) 25 that includes a hopper 26. The hopper 26 supports a stack of documents or originals 28 that are to be copied. A feed roller 30 is placed at the top of the stack by known means and is operative to convey the upper most original 28 into engagement with a deflector 36 and directed into the nip of the first pair of rollers 18. From there the original 28 will be conveyed along the path 24. It will appreciated that the deflector 36 is spaced slightly from the top of the housing 12 to allow originals 28 to be fed manually to the nip to the rollers 18.

An optical system, generally shown at 34, is provided to direct light from a lamp 35 to the exposure station and then to the lower portion of the housing. Rotably supported in the housing 12 is a roll of web material 36 that serves as a source of sheets for the copies.

Located at the lower portion of the housing 12 is a combination of rollers and guides shown generally at 38 and a pair of charge rollers 40. Another pair of rollers 42 is shown downstream from the charge rollers 40 and a pair of fusing rollers 43 is shown downstream from the first pair of rollers. A knife 44 is located between the first combination of rollers and guides 38 and the charge rollers 40 whereby the web 36 may be cut in appropriate lengths in accordance with the length of the original 28 to be copied. A receiving tray and guide members, generally shown at 46, are located downstream from the fusing rollers 43 and collect the complete copies. A development unit 48 is provided for the purpose of developing the image that is created as a result of the light from the optical system 34 falling upon the charged copy sheet 36. The fuser rollers 43 fix the developed image as is well known in the art.

Supported on the housing 10 is a switch panel 50 which includes three switches 52, 54 and 56. One switch 52 is provided for enabling the copier only, another switch for enabling the copier and the ADF 26 and the last switch for turning off the copier 10 as needed.

Figure 2:
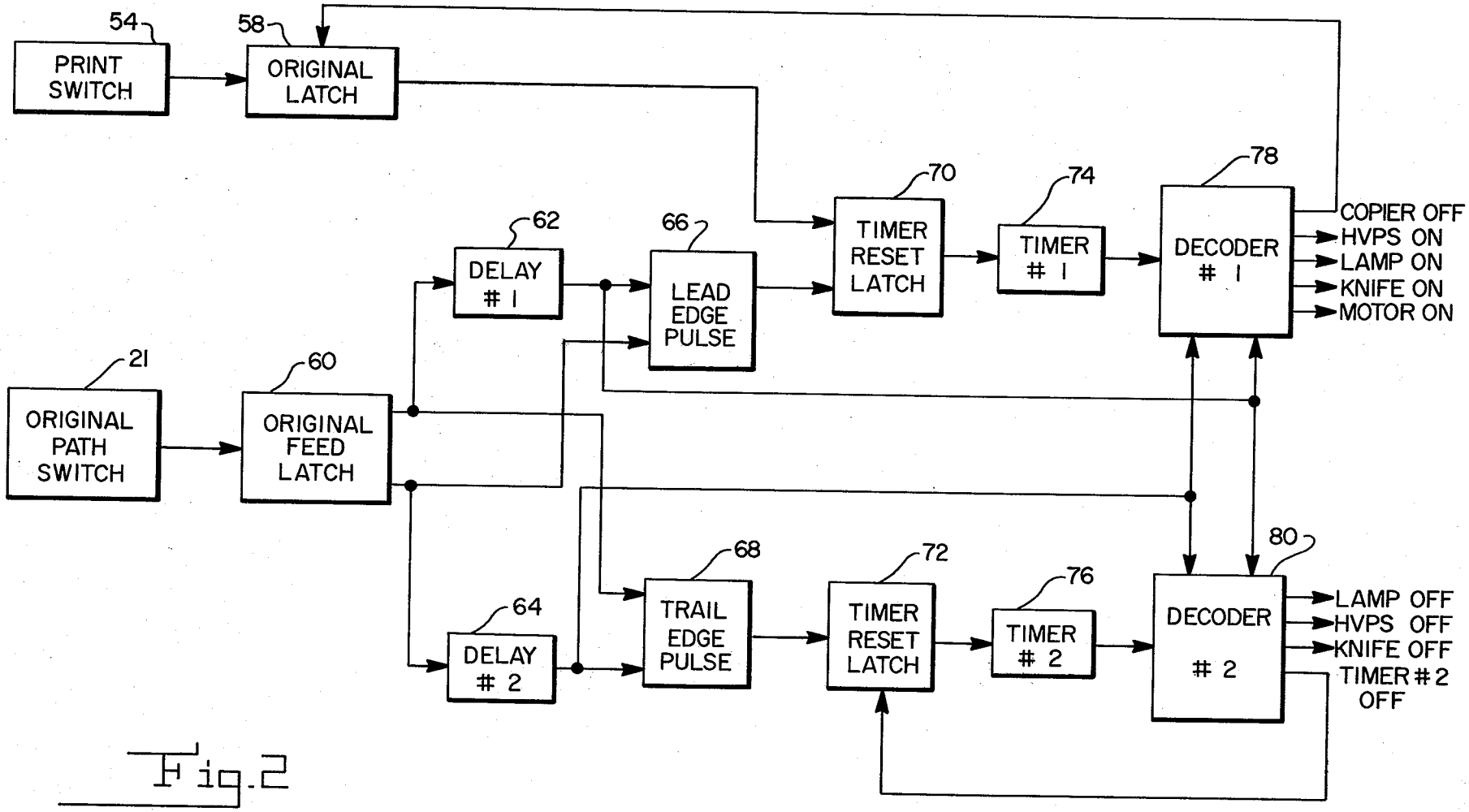
FIG. 2 is a block diagram showing the components and functions involved in the instant invention.

Referring now to FIG. 2, the print and ADF switch 54 is in electrical connection with a print latch 58 and the path switch 21 is connected to a paper feed latch 60. A first delay unit 62 and a second delay unit 64 are connected to the paper feed latch 60 and supply signals to a lead edge pulse unit 66 and a trail edge pulse unit 68, respectively, thereby are also connected to the paper feed latch 60. A first timer reset latch 70 is connected to the print latch 58 and to the lead edge pulse unit 66 and a second timer reset latch 72 receives the signal from the trail edge pulse unit 68. A timer 74 is in connection with the timer reset latch and with a first decoder that is also connected to the print latch and is operative to turn on the high voltage power supply to the charge rollers 40 and the motor which drives the fuser rollers 43, turn on the lamp 35 and turns off the copier 10. A second decoder 80 is connected to the second timer 72 and to the timer reset latch and is operative to turn off the lamp, turn off the high voltage power supply and turn off the knife. The decoder 78 also sets the print latch 58.

In operation, the first timers starts counting when one of the print and ADF switch 54 is actuated, starting the motor of the copier 10 and the automatic document feeder 26. The first timer 74 is reset to "0" when the lead edge of an original 28 is sensed by the path switch 21. The first timer starts to count and will turn off the motor and AC power to the lamp and solenoids at a predetermined time after the print and ADF switch 54 was first actuated or after the lead edge of the last document is sensed, whatever is later. Normally, this is a period of approximately 17 seconds, but the period, of course, will depend on the copy speed of the particular copier. The outputs of the first timer 74 are decoded and used to time all sequential machine functions such as the turning on the lamp, the high voltage power supply, which supplies the power to the charge rollers or any other required component that must or can take place in a fixed time from which the lead edge of the original 28 is sensed.

The second timer 76 is used to turn off the functions such as the knife 44, the high voltage power supply and the lamp 35. The second timer 76 is included so that the first timer 74 can be reset to start the sequence for the next copy cycle when a conveyed original 28 actuates the path switch 21 and before the copy cycle is complete. The second timer 76 is also needed to enable the copier to perform all functions properly in cases where the gap between copies is at a minimum, as for example, 0.5 inches. This occurs when copies are fed manually under the deflector 36. The first timer 74 could be used with some gating to turn off all machine functions, but some method would be required for sequencing the copier with the result that the gap between originals would have to be increased. The use of the second timer 76 allows the copier 10 to accept originals 28 as fast as an operator can feed them so long as there is sufficient gap for the path switch 21 to be actuated and deactuated.

The print and ADF switch 54 sets the print latch 58 which, in cooperation with the lead edge pulse unit 66, enables the first timer 74 to start timing. The first timer 74 outputs are decoded and depending on the state of the original feed latch 60, will either sequence the machine through a copy cycle or sequence the machine until the print latch 58 is reset by the COPIER OFF signal from the first decoder 78.

The first timer 74 is reset by the lead edge of an original 28 which generates a pulse, the duration of which is determined by the first delay unit 62. The second timer 76 is enabled by the trail edge pulse unit 68 if the minimum sheet length requirement has been met or if the path switch 21 is actuated for too long a period. The period of the trail edge unit 68 pulse is set by the second delay unit 64.

The signals from the delay units 62, 64 are used by the decoders 78, 80 so that the timers 74, 76 can be at any count when the original latch 58 and the original feed latch are set and generate the lead edge pulse for reset and generate the trail edge pulse. The timers must be reset to "0" before they enable the setting of any control latches by the decoder outputs.

I claim:

1. A dual timing system for the sequential control of a copier operative to produce copies of originals, comprising:

a print switch operative to start the copier, a switch located on the path along which the originals are conveyed, a first timer for starting the sequence of operation of the components of the copier, said first member being enabled when said path switch senses the leading edge of an original, a second timer for terminating the operation of components of the copier, said second timer being enabled by the trailing edge of an original being sensed by the path switch.

2. A dual timing system for the sequential control of a copier operative to produce copies of originals, the copier having a path over which originals to be copied are conveyed past an exposure station, comprising:

a print switch operative to start the copier, a path switch located on the path along which the originals are conveyed, a first timer for controlling the sequence of operation of the components of the copier, said first timer connected to said path switch and being enabled to output timing signals when said path switch senses the leading edge of an original and reset upon said path switch sensing the leading edge of a subsequent original, a second timer connected to said path switch, said second timer being enabled by the trailing edge of an original being sensed by the path switch to output timing signals, and means for decoding the outputs from said second timer to turn off the functions of components of the copier.

3. A dual timing system for the sequential control of a copier operative to produce copies of originals, the copier having a path over which originals to be copied are conveyed past an exposure station, comprising:

a switch located on the path along which the originals are conveyed, a first timer for starting the sequence of operation of the components of the copiers, said first timer being enabled when said path switch senses the leading edge of an original and reset upon said switch sensing the leading edge of a subsequent original, a second timer for turning off components of the copier, said second timer being enabled by the trailing edge of an original being sensed by the path switch.

4. The dual timing system of claim 3 including delay means connected to said second timer and to said switch to delay the time at which the copier components are turned off.

5. The dual timing system of claim 3 wherein said first timer terminates operation of the copier after a selected period from the time the leading edge of an original is sensed by said path switch.

* * * * *